US006089494A

United States Patent [19]

Tholen et al.

[11] Patent Number: 6,089,494

[45] Date of Patent: Jul. 18, 2000

[54] BOBBIN TRANSPORT SYSTEM FOR A BOBBIN WINDING MACHINE

[75] Inventors: Leo Tholen, Heinzberg; Uwe Fabelje, Mönchengladbach; Helmut Kohlen, Erkelenz, all of Germany

[73] Assignee: W. Schlafhorst AG & Co., Moenchengladbach, Germany

[21] Appl. No.: 09/237,303

[22] Filed: Jan. 26, 1999

[30] Foreign Application Priority Data

Feb. 5, 1998 [DE] Germany ..... 198 04 413

[51] Int. Cl.[7] ..... B65H 67/02; B65H 54/22

[52] U.S. Cl. ..... 242/474.1

[58] Field of Search ..... 242/474.1, 470, 242/474.2

[56] References Cited

U.S. PATENT DOCUMENTS

| | | | |
|---|---|---|---|
| 4,544,107 | 10/1985 | Matsui et al. | 242/474.1 |
| 4,597,540 | 7/1986 | Kiriake | 242/474.1 |
| 5,374,000 | 12/1994 | Matsui et al. | 242/474.1 |
| 5,544,629 | 8/1996 | Bucken et al. | 242/474.1 |

FOREIGN PATENT DOCUMENTS

| | | |
|---|---|---|
| 32 13 153 C2 | 12/1984 | Germany . |
| 196 17 469 A1 | 11/1997 | Germany . |

*Primary Examiner*—Donald P. Walsh
*Assistant Examiner*—Collin A Webb
*Attorney, Agent, or Firm*—Kennedy Covington Lobdell & Hickman, LLP

[57] ABSTRACT

In a bobbin winding machine with plural winding stations (13), a bobbin transport system for conveying bobbins to be unwound to and from the winding stations comprises a feed track (10), an oppositely located removal track (14) and plural transverse transport tracks (16) extending therebetween through an unwinding position (17) of an associated winding station. The winding station (13) has a positioning element (18), which positions and holds a transport element (11) with a spinning bobbin (12) in the unwinding position and releases it after unwinding. A device (31), preferably combined as an integral unit with the positioning element (18), is additionally associated with each transverse transport track to limit the capacity of the transverse transport track to accept only a single transport element (11) between the positioning element (18) and the removal track (14).

5 Claims, 1 Drawing Sheet

BOBBIN TRANSPORT SYSTEM FOR A BOBBIN WINDING MACHINE

FIELD OF THE INVENTION

The present invention relates generally to textile bobbin winding machines for rewinding spinning bobbins, sometimes referred to as spinning cops, into larger volume yam packages, sometimes referred to as cheeses. More particularly, the present invention relates to bobbin winding machines having a plurality of aligned winding stations and a transport system for conveying spinning bobbins supported in upright disposition on pallet-like transport elements to and from the winding stations.

BACKGROUND OF THE INVENTION

Textile winding machines of the above-mentioned type commonly employ a bobbin transport system having a feed track extending along several aligned winding stations for conveying transport elements each carrying a spinning bobbin to be unwound, a removal track extending along the opposite side of the winding stations for conveying transport elements each carrying an unwound spinning bobbin, and transverse transport tracks each extending from the feed track to the removal track through a respective winding station, with each transverse transport track having a positioning element selectively movable into and out of the associated transverse transport track for positioning a transport element at, and releasing the transport element from, an unwinding position at the associated winding station.

A bobbin winding machine of the above-mentioned type is described in German Patent Publication DE 196 17 469 A. With a bobbin winding machine of this type it is possible, if unfortunate circumstances occur, that the transport elements back up in the outlet area of a transverse transport track and therefore result in also blocking the removal track, which can only be remedied by the action of an operator. It is possible, for example, that a transport element with an empty tube projects out of the transverse transport track partially onto the removal track. As other transport elements are conveyed on the removal track past the outlet of such transverse transport track, the transport elements will tend to push the projecting transport element back into the transverse transport track. However, if the projecting transport element cannot be pushed back into the transverse transport track because a further transport element is already present thereon, there is the danger of the transport element becoming jammed in the outlet area and therefore blocking the transport of elements on the removal track.

OBJECT AND SUMMARY OF THE INVENTION

It is accordingly an object of the present invention to provide a bobbin winding machine of the general type mentioned above which will largely prevent the danger of blocking the removal track of the bobbin transport system.

This object is attained by providing an arrangement, mechanism or other suitable means which can be moved into and out of the transverse transport track in association with the transport elements thereon to limit the capacity of the transverse transport track to accept only a single transport element between the positioning element and the removal track.

By thusly assuring that there is space for only one transport element between the positioning element and the removal track, the transport element can be completely pushed back into the transverse transport track if during its exit from the outlet it should encounter a transport element passing on the removal track, and therefore the transport element does not block the conveyance of transport elements on the removal track.

In a further embodiment of the invention it is provided that the means for limiting the acceptance capacity of the transverse transport track is combined with a positioning element of the respective winding station used for properly positioning each transport element and bobbin in an unwinding position at the winding station. In this manner, since the respective positioning element with its associated drive is already provided on such machines, the additional capital outlay required for the present invention is kept relatively low.

Further characteristics and advantages of the invention will be described and understood from the following description of an exemplary embodiment represented in the accompanying drawings.

DETAILED DESCRIPTION OF THE PREFERRED EMBODIMENT

Figure 1:
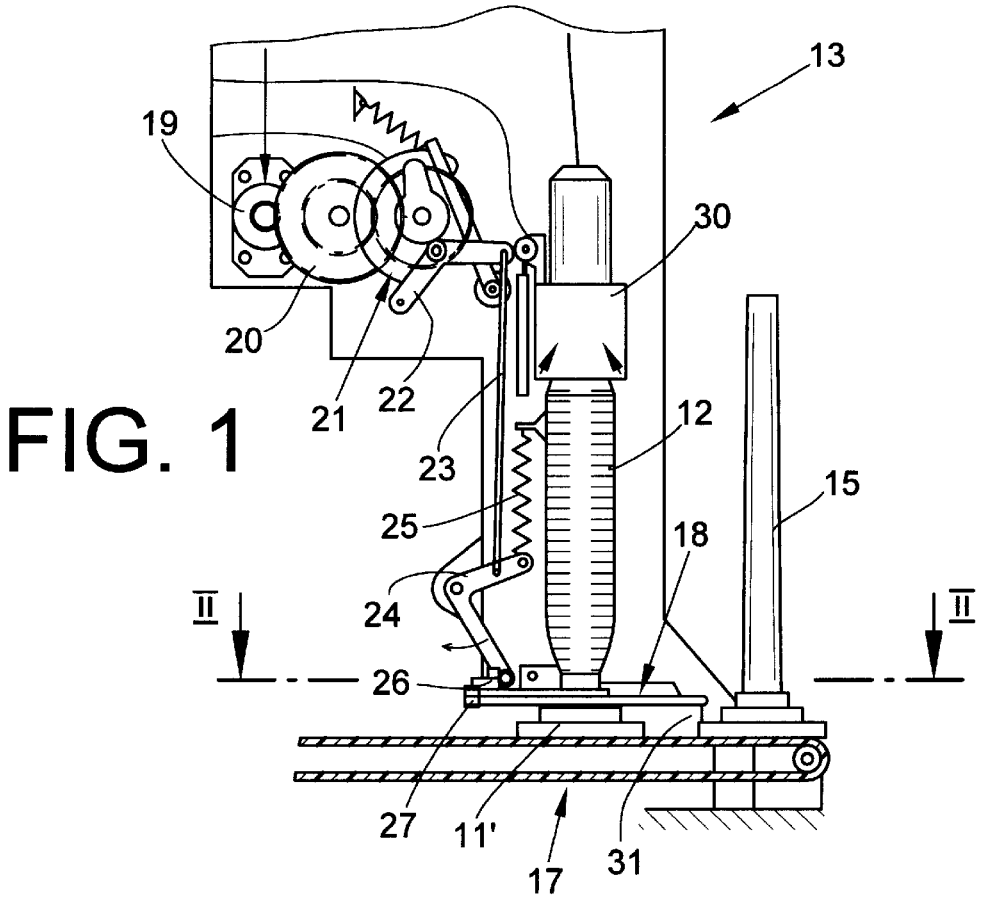
FIG. 1 is a side elevational view of an individual winding station of a bobbin winding machine in accordance with the present invention.
Figure 2:
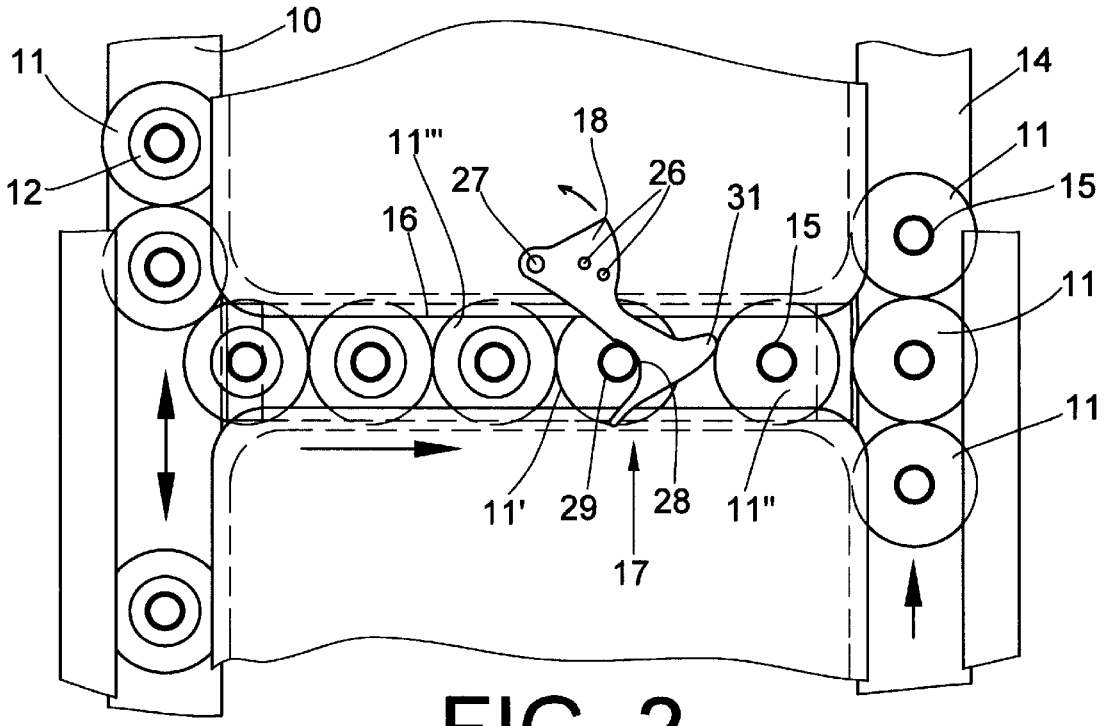
FIG. 2 is a horizontal cross-section of the winding station of FIG. 1 taken along the line II—II thereof.

Referring now to the accompanying drawings, a bobbin transport system for a multi-station bobbin winding machine comprises a feed track 10 extending along one side of the aligned winding stations 13 (only one of which is shown) on which are conveyed pallet-like transport elements 11 carrying upstanding spinning bobbins 12 to be rewound at the winding stations. Each transport element comprises a cylindrical base plate or a spoked ring and a central raised hub having a lower neck portion and an upper pin onto which the bobbin tube 15*a* of a spinning bobbin 12 is pressed to be supported in an upstanding disposition.

A removal track 14 extends in parallel relation to the feed track 10 along the winding stations 13 at the opposite side thereof from the feed track 10, on which removal track 14 are conveyed the transport elements 11 with the spinning bobbins after being unwound at the winding stations 13, i.e. typically empty bobbin tubes 15 (but it may occur for various reasons that a spinning bobbin 12 is not completely unwound in a winding station 13, for example if a yarn break has occurred which cannot be automatically remedied in the winding station 13, so that also only partially unwound spinning bobbins reach the removal track 14).

The feed track 10 and the removal track 14 are connected with each other by means of a plurality of transverse transport tracks 16 each of which is associated with a respective one of the winding stations 13 such that the transport elements 11 with full spinning bobbins 12 respectively pass through a winding station 13.

The winding stations 13 each have an unwinding position 17, in which a transport element 11' is positioned by means of a positioning element 18 during the unwinding of the spinning bobbin 12. The positioning element 18 comprises a plate which is pivotable around a vertical shaft 27 positioned next to the transverse transport track 16 and in front of the unwinding position 17 such that a portion of the positioning element 18 having a receiving notch 28 essentially moves transversely with respect to the associated transverse transport track 16. The receiving notch 28 engages the transport element 11' by its neck portion 29.

The positioning element 18 can be pivoted by means of a drive arrangement out of the inwardly pivoted position represented in the drawings in which the unwinding position 17 is defined, and back again into the unwinding position 17. The drive arrangement for the positioning element comprises a drive motor 19 which drives a control cam package 21 via a reduction gear 20. One of the control cams drives a cam lever 22, which is connected via an actuating rod 23 with an actuating lever 24 which is held by means of a tension spring 25 in the position represented, in which the positioning element 18 is pivoted inwardly with respect to the associated transverse transport track 16. The actuating lever 24 has a shoulder which extends between two detent pins 26 on the positioning element. The control cam package 21 also drives further elements of the winding station, which are not shown in detail, for example, an arrangement 30 for picking up a yarn end from a spinning bobbin 12 freshly placed into the unwinding position 17.

Only the empty spinning tube 15 (or possibly a partially unwound tube with remnant windings in case of a yam break during unwinding) remains on the transport element 11 after unwinding of the spinning bobbin 12. The transport element 11' is then released by means of the positioning element 18 pivoting outwardly from the transverse transport track 16, so that the transport element 11' is then transported along the transverse transport track 16 in the direction toward the removal track 14. The transverse transport track 16 is provided with a conveyor arrangement moving from the feed track 10 to the removal track 14, for example two conveyor belts extending parallel at a spacing from each other, which transport the transport element 11' released from the outwardly pivoted positioning element 18 to the removal track 14 and transfer it to the latter, and also advance the transport elements 11 which are in reserve in front of the unwinding position 17 such that the next transport element 11' with a spinning bobbin to be unwound is advanced into the unwinding position 17 and is held there by the positioning element 18 upon being again pivoted inwardly across the transverse transport track 16.

The plate-like positioning element 18 has an elongated nose portion extending in the direction toward the removal track 14 with a hub portion 31 projecting downwardly therefrom to be disposed in the inwardly pivoted position of the positioning element 18 immediately above the transverse transport track 16 at the level of the base plates of the transport elements 11. With its hub portion 31, the positioning element 18 limits the acceptance capacity of the transverse transport track 16 in the outlet area downstream of the winding position 17 toward the removal track 15 in such a way that space exists thereon for only one transport element 11". In this manner, it is assured that this exiting transport element 11" can be pushed back into the transverse transport track 16 if, upon leaving the transverse transport track, it engages a transport element moving along the removal track 14. Thus, there is a relatively high degree of assurance that a transport element 11 which has partially left the transverse transport track 16 and contacts against a transport element 11 being transported on the removal track 14 will not become jammed into the outlet area of the transverse transport track 16.

The feed track 10, the transverse transport tracks 16 and the removal track 14 have essentially been represented only schematically, since their specific design is not important for the invention. Basically, the feed track 10 and the transverse transport track 16 can be designed in accordance with German Patent Publication DE 41 42 790 A1. In particular, the transverse transport tracks 16 can have two parallel extending transverse conveyor belts which travel continuously, or which are only driven when an empty space for receiving a transport element 11 is provided on the transverse transport track 16, and when a change is made at the unwinding position.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A bobbin winding machine comprising a plurality of aligned winding stations and a transport system for conveying spinning bobbins supported in upright disposition on transport elements to and from the winding stations, the bobbin transport system having a feed track extending along one side of the winding stations for conveying transport elements each carrying a spinning bobbin to be unwound, a removal track extending along the opposite side of the winding stations for conveying transport elements each carrying an unwound spinning bobbin, and a plurality of transverse transport tracks each extending from the feed track to the removal track through a respective winding station, each transverse transport track having a positioning element selectively movable into and out of the associated transverse transport track between a first position operative during unwinding operation of the associated winding station wherein the positioning element is disposed within the transverse transport track for engaging and positioning a transport element at an unwinding position at the associated winding station and a second position operative after completion of an unwinding operation of the associated winding station wherein the positioning element is disposed outside the transverse transport track for releasing the transport element from the unwinding position at the associated winding station, and each positioning element having a device movable therewith between the first and second positions into and out of the associated transverse transport track, the device being configured to occupy a sufficient extent of the associated transport track between the unwinding position and the removal track for limiting the capacity of the transverse transport track to be occupied fully by at least one transport element between the device and the removal track during the unwinding operation.

2. The bobbin winding machine in accordance with claim 1, wherein the device for limiting the capacity of the transverse transport track and the positioning element for each transverse transport track are formed as an integral unit.

3. The bobbin winding machine in accordance with claim 2, wherein each positioning element has a projecting portion at a side thereof facing the removal track and extending into the transverse transport track for engaging a transport element disposed between the positioning element and the removal track.

4. The bobbin winding machine in accordance with claim 3, wherein the unit of the positioning element and the projecting portion is movable essentially transversely with respect to the transverse transport track.

5. The bobbin winding machine in accordance with claim 4, wherein the projecting portion comprises a hub portion projecting downwardly from the positioning element toward the transverse transport track to a level of the transport elements thereon.

* * * * *